US010953295B2

(12) United States Patent
Modlin

(10) Patent No.: US 10,953,295 B2
(45) Date of Patent: Mar. 23, 2021

(54) CORNHOLE BAG AND RELATED PROCESS

(71) Applicant: Frank Modlin, Jamesville, NC (US)

(72) Inventor: Frank Modlin, Jamesville, NC (US)

( * ) Notice: Subject to any disclaimer, the term of this patent is extended or adjusted under 35 U.S.C. 154(b) by 0 days.

(21) Appl. No.: 16/405,774

(22) Filed: May 7, 2019

(65) Prior Publication Data

US 2019/0344142 A1 Nov. 14, 2019

Related U.S. Application Data

(60) Provisional application No. 62/669,371, filed on May 9, 2018.

(51) Int. Cl.
*A63B 67/06* (2006.01)

(52) U.S. Cl.
CPC ..... *A63B 67/06* (2013.01); *A63B 2209/023* (2013.01)

(58) Field of Classification Search
CPC ..... A63B 67/06; A63B 2209/023
USPC ..... 273/402
See application file for complete search history.

(56) References Cited

U.S. PATENT DOCUMENTS 3,480,280 A * 11/1969 Gamertsfelder ..... A63B 67/06 473/594
5,165,695 A * 11/1992 Yoder ..... A63B 63/00 273/402
5,332,230 A * 7/1994 Benedict ..... A63B 67/06 273/400
5,333,879 A * 8/1994 Barnes ..... A63B 63/007 273/400
5,765,832 A * 6/1998 Huff ..... A63B 63/08 273/354
5,871,216 A * 2/1999 Sparacino ..... A63B 63/08 273/402
5,909,877 A * 6/1999 Bour ..... A63B 67/06 273/402
7,237,777 B2 * 7/2007 Digges, III ..... A63B 67/06 273/400
7,775,525 B2 * 8/2010 Staver ..... A63B 67/06 273/317.1
8,157,265 B2 * 4/2012 Conville ..... A63B 67/06 273/402

(Continued)

OTHER PUBLICATIONS

Esty Review for "8 Cornhole Bags Custom Embrodered: Superman/Batman." 1 page, posted Nov. 7, 2017 by user Jolene Nance. Retreived from Internet: <https://www.etsy.com/shop/debbierofstad/reviews?ref=pagination&page=13>.

(Continued)

*Primary Examiner* — John E Simms, Jr.
*Assistant Examiner* — Dolores R Collins
(74) *Attorney, Agent, or Firm* — Sam IP Legal Solutions, PC.; Ryan D. Sam

(57) ABSTRACT

A cornhole bag includes a top surface, a bottom surface, and a filling. The bottom surface includes a first material and a second material with differing coefficients of friction in relation to a cornhole board. The top surface may also include a first material and a second material with differing coefficients of friction in relation to a cornhole board. Accordingly, the cornhole bag may be tossed toward a cornhole board such that the differing materials of the cornhole bag make contact with the cornhole board at different times.

20 Claims, 6 Drawing Sheets

(56) References Cited

U.S. PATENT DOCUMENTS

| | | | | |
|---|---|---|---|---|
| 9,550,101 | B2 * | 1/2017 | Janeri | A47C 4/08 |
| 2012/0038108 | A1 * | 2/2012 | McLaughlin, Jr. | A63B 63/08 273/402 |
| 2014/0374992 | A1 * | 12/2014 | Reile | A63B 63/08 273/402 |
| 2015/0084283 | A1 * | 3/2015 | Endreszl | A63B 63/08 273/398 |
| 2015/0108719 | A1 * | 4/2015 | Devine | A63B 63/08 273/402 |
| 2015/0231467 | A1 * | 8/2015 | Sciandra | A63B 67/06 273/402 |
| 2017/0014704 | A1 * | 1/2017 | Bell | A63B 67/06 |
| 2017/0361993 | A1 * | 12/2017 | Sharp | B65D 33/18 |

OTHER PUBLICATIONS

CraftsbySueL Etsy 2015 sales and reviews.†

Hes L, Marmarali A, ÖZDİL N , Oglakcioglu N , Lima M . The Effect of Moisture on Friction Coefficient of Elastic Knitted Fabrics. Textile arid Apparel. 2008; 18(3): 206-210. Available online at <https://dergipark.org.tr/en/download/article-file/218065>. †

ACO Pro 450 Cornhole bag sold in 2017.†

* cited by examiner
† cited by third party

CORNHOLE BAG AND RELATED PROCESS

RELATED APPLICATIONS

This application claims priority to U.S. Provisional Application Ser. No. 62/669,748, filed May 9, 2018.

BACKGROUND OF THE INVENTION

The game cornhole, also known as beanbag toss, bags, tailgate toss, baggo, sack toss, and bean sack, is a popular lawn game at gatherings of families and friends and is also played as a competitive sport. Cornhole is a lawn game or sport where two cornhole boards, slanted boards with a six-inch diameter hole through the top surface, are placed approximately twenty-seven feet apart. Players stand at the side of one cornhole board and toss cornhole bags at the other cornhole board. Players try to land the cornhole bag on the cornhole board to gain one point or try to land the cornhole bag through the six-inch diameter hole to gain three points. The player who first reaches twenty-one points is the winner. There are many variations of play among causal cornhole fans, but as a competitive sport, cornhole has set rules and equipment standards.

Cornhole is a very old game, dating back to the 1800s, but has become increasingly popular in recent years. This is made evident by the formation of cornhole tournaments across the nation, including high school cornhole tournaments, college cornhole tournaments, and national cornhole tournaments. Furthermore, the World Championships of Cornhole have recently been broadcast by ESPN.

As the sport cornhole has become increasingly more popular and because more and more people have become competitive players of cornhole, advances and improvements in cornhole equipment have become necessary and would be welcomed. More particularly, advances and improvements in cornhole bags would be well received by the public—especially by competitive players of cornhole.

Accordingly, there is a continuing need for advances and improvements in cornhole equipment, including advances and improvements in cornhole bags.

SUMMARY OF THE INVENTION

A cornhole bag is used as the projectile in the game of cornhole. The cornhole bag may be comprised of a first surface, a second surface and a filling. The filling may be enclosed between the first surface and the second surface. The second surface may be comprised of a first material and a second material. The first material and the second material may be durable woven fabrics.

The first material and the second material of the second surface may be adjacent to each other. In addition, the first material may completely border the second material. The second material may be in the shape of a quadrilateral. Alternatively, the second material may be in the shape of an ellipse or some other shape. The second material may have a different coefficient of friction in relation to a cornhole board than the first material. In one embodiment, the second material may have a coefficient of friction in relation to a cornhole board which is greater than the coefficient of friction of the first material in relation to a cornhole board.

The first surface may be comprised of a single material. The single material of the first surface may be the same material as the first material of the second surface. Alternatively, the first surface may be comprised of a third material and a fourth material. The third material of the first surface may be adjacent to the fourth material of the first surface. The third material of the first surface may completely boarder the fourth material of the first surface. The fourth material may be in the shape of a quadrilateral, in the shape of an ellipse, or in some other shape.

The cornhole bag may be provided to be used by a player in the game of cornhole. The player may toss the cornhole bag in a parabolic pathway toward a cornhole board. The cornhole bag may be tossed such that it lands on the cornhole board with the first material of the second surface making contact with the cornhole board before the second material of the second surface makes contact with the cornhole board. Alternatively, the cornhole bag may be tossed such that it lands on the cornhole board with the first material of the second surface and the second material of the second surface making contact with the cornhole board at substantially the same time. Alternatively, the cornhole board may be tossed such that it lands on the cornhole board with the first surface making contact with the cornhole board.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
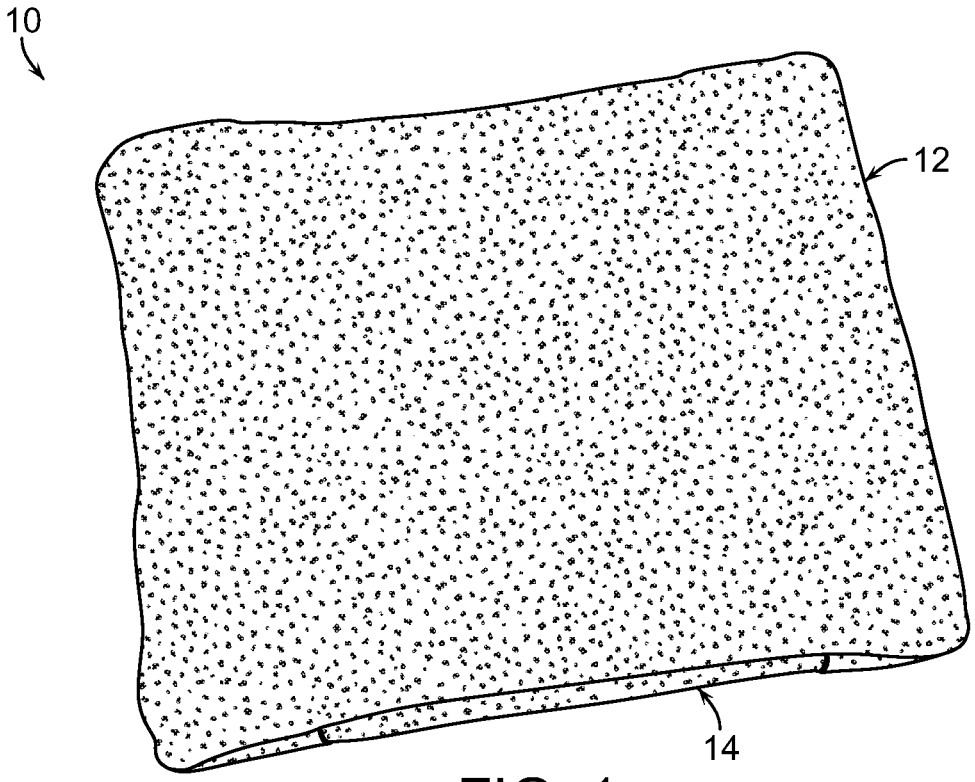
FIG. 1 illustrates a top perspective view of a cornhole bag.

As shown in the drawings and for purposes of illustration, the present invention is directed to a cornhole bag, generally referred to by the reference number 10. Generally, the cornhole bag 10 is used as the projectile to score points in the game cornhole. The cornhole bag 10 is tossed toward a cornhole board. The goal is to either land the cornhole bag on the cornhole board or through an aperture in the cornhole board. During the game, the cornhole bag 10 bumps into other cornhole bags, lands on the cornhole board, slides on the cornhole board, falls through the aperture in the cornhole board, or acts as a blockade to other incoming cornhole bags.

Figure 2:
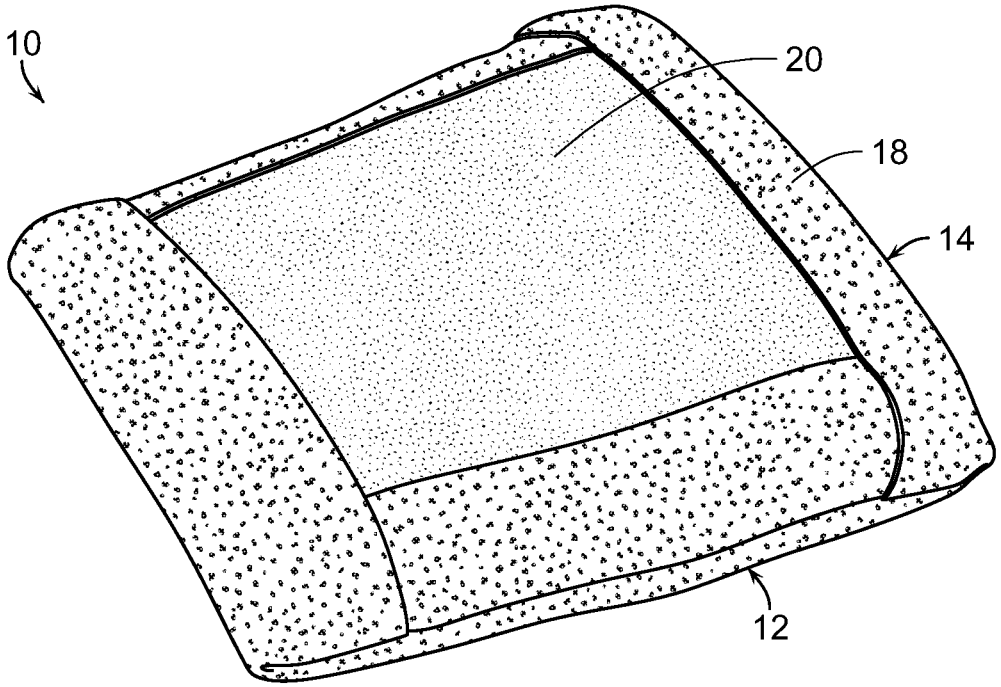
FIG. 2 illustrates a bottom perspective view of the cornhole bag of FIG. 1.
Figure 3:
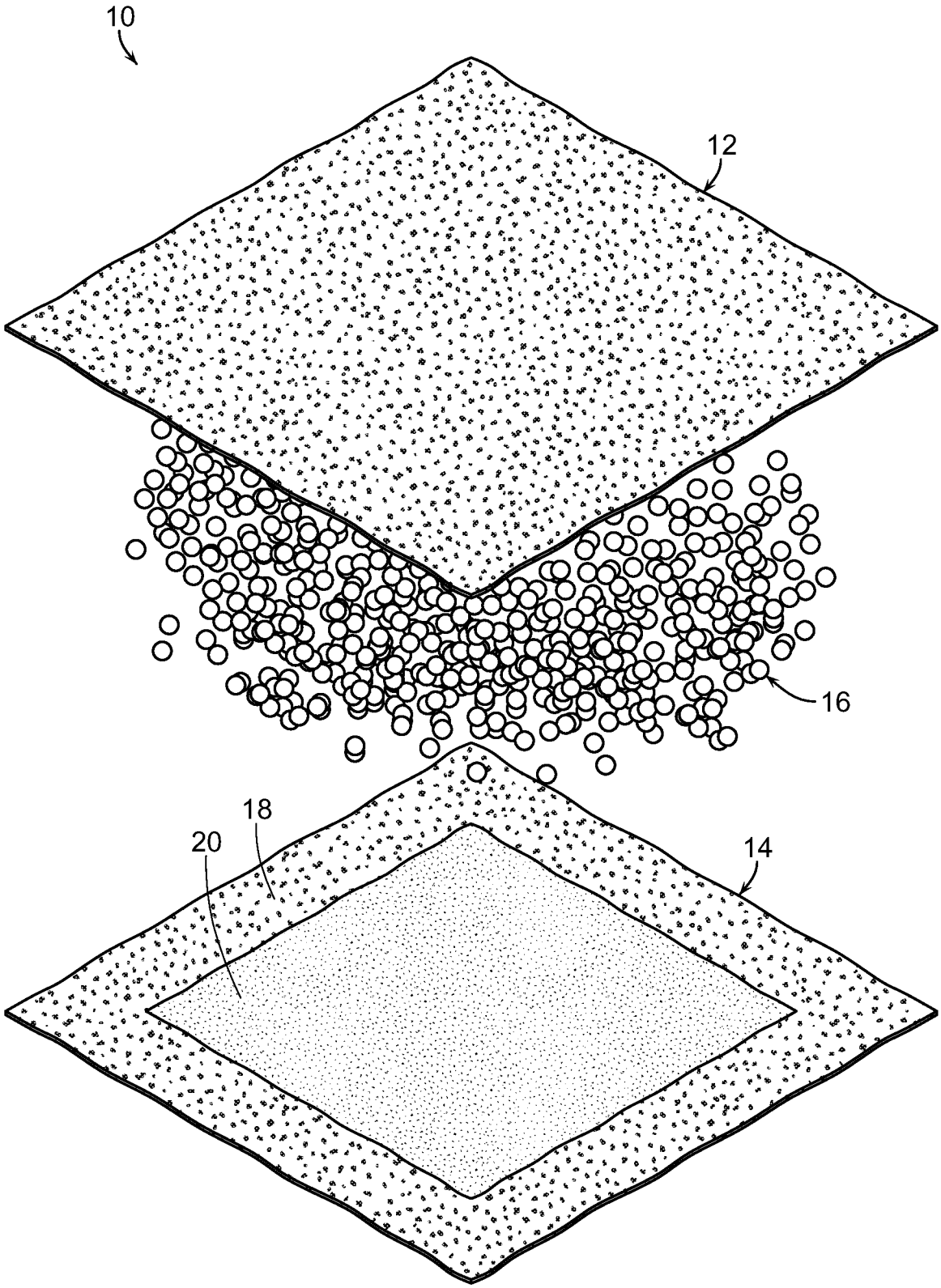
FIG. 3 illustrates an exploded perspective view of the cornhole bag of FIGS. 1 and 2.

With reference to FIGS. 1-3, an embodiment of the cornhole bag 10 is illustrated. The cornhole bag 10 may be comprised of a first surface 12, a second surface 14, and a filling 16. The first surface 12 and the second surface 14 may be identical in shape and size and may be in the shape of a square, such that the top surface 12 and the bottom surface 14 each have four sides which are equal in length and wherein adjacent sides form ninety-degree angles. The sides may be about five-and-three-quarters-inches to about six-and-one-quarter-inches in length. However, the length of the sides could be smaller or larger than this range. The filling 16 may be dry corn feed, dry beans, plastic pellets, rubber pellets, or some other similar filling. Enough filling 16 may be used so as to bring the total weight of the cornhole bag 10 to be between about twelve and about eighteen ounces.

The cornhole bag 10 is generally made by attaching any three of the sides of the first surface 12 to the corresponding three sides of the second surface 14 such that the top surface 12 and the bottom surface 14 form a pocket. Alternatively, the top surface 12 and the bottom surface 14 may be one piece, a rectangle composed of two squares of the same size, where the first surface 12 is folded over the second surface 14 and where the two sides of the first surface 12 adjacent to the fold are attached to the corresponding two sides of the second surface, forming a pocket. The filling 16 is then placed between the first surface 12 and the second surface 14 such that the filling 16 is housed within the pocket. Finally, the remaining side of the first surface 12 is attached to the corresponding side of the second surface 14 such that the filling 16 is secured between the first surface 12 and the second surface 14. The attachment of the sides of the first surface 12 to the corresponding sides of the second surface 14 may be done by sewing the sides together, by gluing the sides together, by stapling the sides together, by a combination of the foregoing, or by some other means known in the art.

Figure 8:
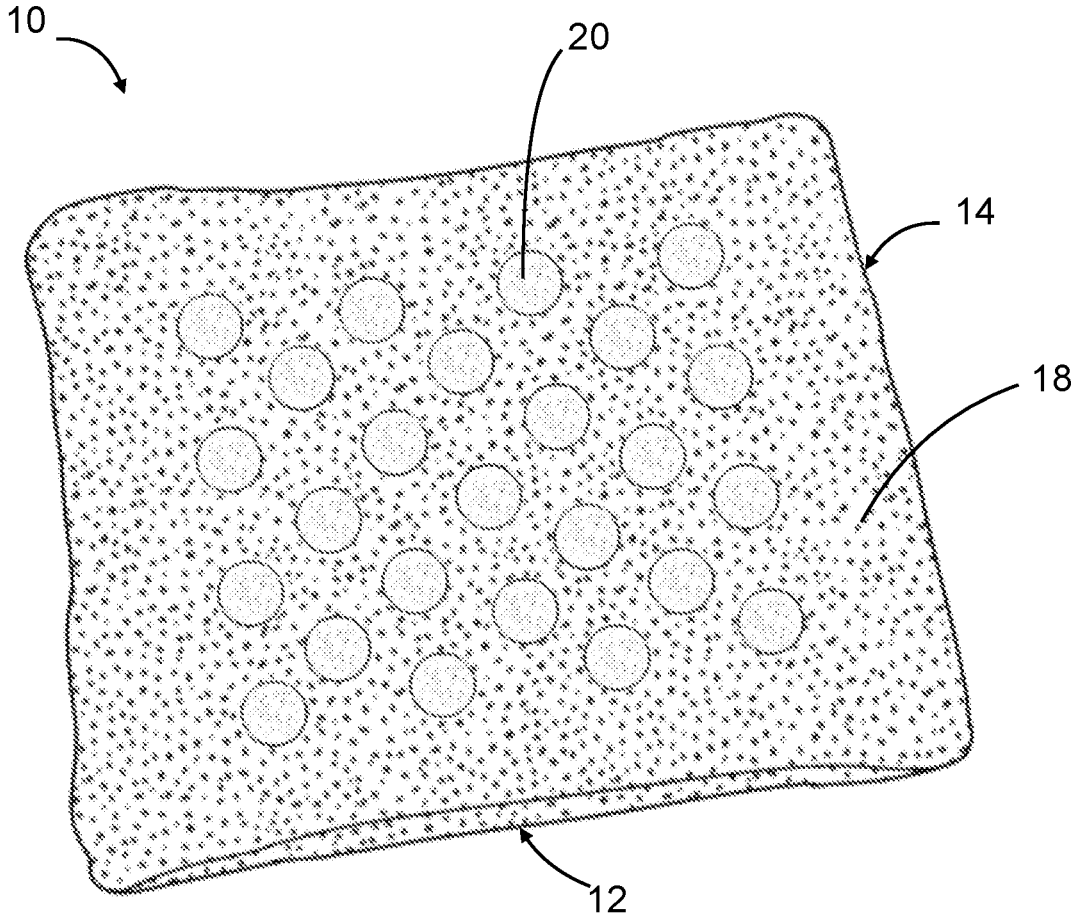
FIG. 8 illustrates a bottom perspective view of another alternative embodiment of the cornhole bag of FIGS. 1-3.
Figure 9:
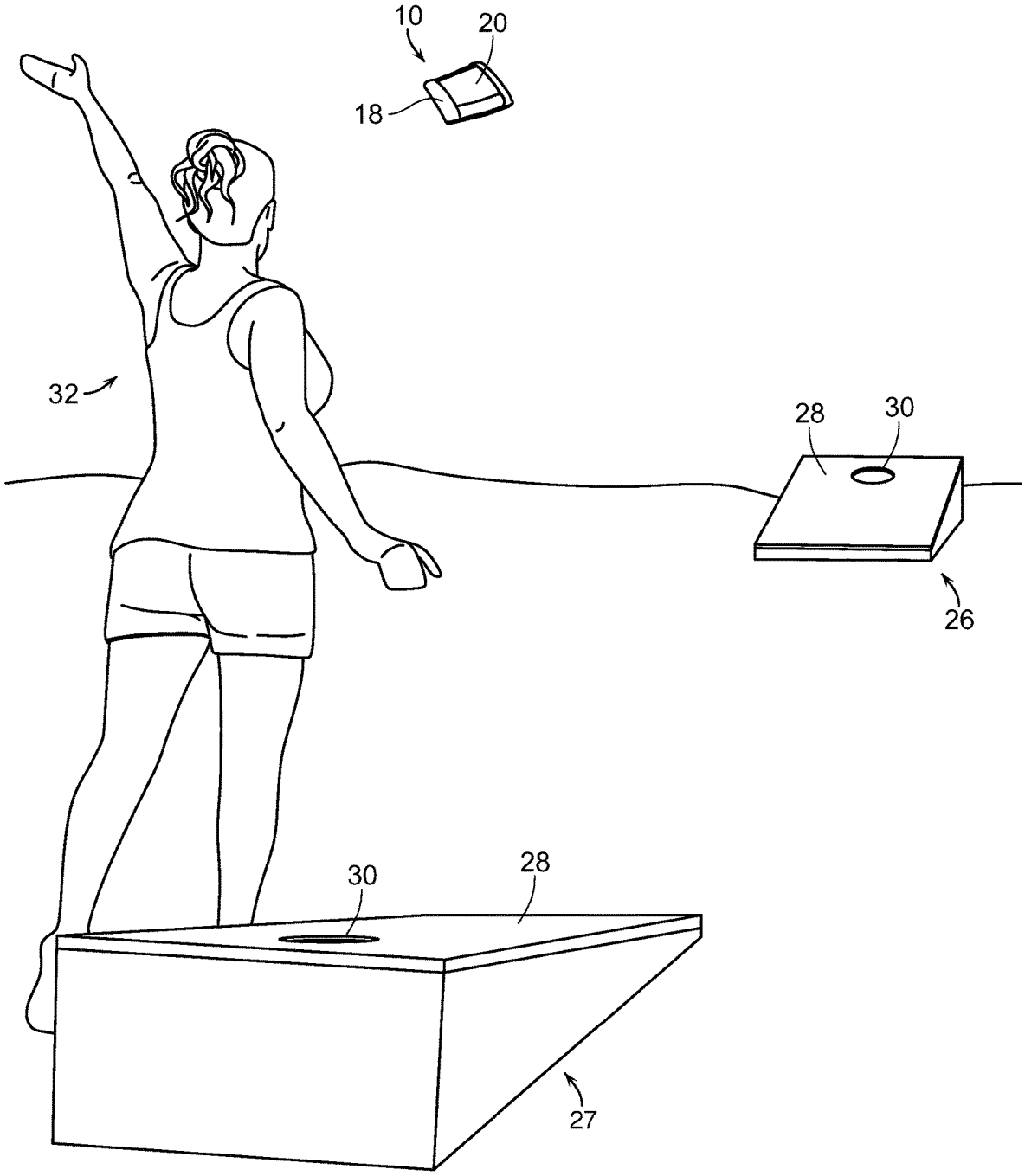
FIG. 9 illustrates an environmental view of the cornhole bag of FIGS. 1-3 being tossed toward a cornhole board.

The first surface 12 may be comprised of a single material which may be a durable fabric canvas, such as a durable woven cotton fabric, a durable woven linen fabric, a durable woven polyester fabric, a durable neoprene fabric, a durable elastomeric coated fabric, or some other strong and durable material known in the art such that when the cornhole bag 10 is tossed and lands on a cornhole board 26 (as seen in FIG. 8) or on the ground, the material will not rip or tear open causing the filling 16 to spill out of the cornhole bag 10. The second surface 14 may be comprised of a first material 18 and a second material 20. The first material 18 may be identical to the material comprising the first surface 12. The second material 20 may be a different material than the first material 18. The second material 20 may also be a durable woven cotton fabric, a durable woven linen fabric, a durable woven polyester fabric, a durable neoprene fabric, a durable elastomeric coated fabric, or some other strong and durable material known in the art.

With reference now specifically to FIGS. 2 and 3, the second material 20 may be in the shape of a quadrilateral. For example, the second material 20 may be in the shape of a square. In relation to the first material 18, the second material 20 may be adjacent to the first material 18. In addition, the second material 20 may be surrounded by the first material 18 such that the first material 18 forms a frame around the second material 20 so as to completely border the second material 20. The second material 20 may range in size from a square with about quarter-inch sides to a square with about five-and-three-quarters-inch sides. The thickness of the boarder formed by the first material 18 may correspondingly range from about five-and-three-quarters-inches to about a quarter-inch such that the second surface 14 is about a six-inch square. For example, in one embodiment, the second material 20 may be a five-inch square with the first material 18 being a border with a thickness of one-inch. However, the exact size of the first material 18 and the second material 20 may be adjusted to accommodate a larger cornhole bag 10 or a smaller cornhole bag 10 and are not limited to the size description above.

The second material 20 may have a friction coefficient in relation to the cornhole board 26 that is larger than the friction coefficient of the first material 18 in relation to the cornhole board 26. This frictional coefficient may be the static frictional coefficient or may be the kinetic frictional coefficient. Thus, when the cornhole bag 10 sits on or slides along the cornhole board 26, the second material 20 will have a larger frictional force acting against motion than the first material 18.

The static frictional force acting against motion of the second material 20 as it lies on a cornhole board 26 is generally measured by the following equation:

$$F_{s2} \leq u_{s2} N$$

'$F_{s2}$' is the static frictional force acting against the motion of the second material 20 lying on the cornhole board 26;

'$u_{s2}$' is the coefficient of static friction of the second material 20 in relation to the cornhole board 26;

'N' is the normal force.

The static frictional force acting against the motion of the first material 18 as it lies on a cornhole board 26 is generally measured by the following equation:

$$F_{s1} \leq u_{s1} N$$

'$F_{s1}$' is the static frictional force acting against the motion of the first material 18 lying on the cornhole board 26;

'$u_{s1}$' is the coefficient of static friction of the first material 18 in relation to the cornhole board 26;

'N' is the normal force.

The kinetic frictional force acting against the motion of the second material 20 as it slides along a cornhole board 26 is generally measured by the following equation:

$$F_{k2} = u_{k2} N$$

'$F_{k2}$' is the kinetic frictional force acting against the motion of the second material 20 sliding along the cornhole board 26;

'$u_{k2}$' is the coefficient of kinetic friction of the second material 20 in relation to the cornhole board 26;

'N' is the normal force.

The kinetic frictional force acting against the first material 18 as it slides along a cornhole board 26 is generally measured by the following equation:

$$F_{k1} = u_{k1} N$$

'$F_{k1}$' is the kinetic frictional force acting against the motion of the first material 18 sliding along the cornhole board 26;

'$u_{k}$,' is the coefficient of kinetic friction of the first material 18 in relation to the cornhole board 26; and 'N' is the normal force.

As can be seen from the above equations, generally the higher the coefficient of friction, the higher the frictional force and vice versa. When the static frictional force is at its maximum value, the second material 20 may have a static friction coefficient in the range of about 0.35 to about 0.6 in relation to the upper surface 28 of a cornhole board 26. When the static frictional force is at its maximum value, the first material 18 may have a static friction coefficient in the range of about 0.18 to about 0.3 in relation to a cornhole board 26. However, since the frictional coefficient is highly dependent upon the materials used, including the finishing of the cornhole board, the second material 20 and the first material 18 may vary slightly from these ranges of static friction coefficients. When the static frictional force is at its maximum value, the difference between the static friction coefficients of the second material 20 and the first material 18 may be in the range of about 0.05 to about 0.42.

The cornhole bag 10 is not limited to this configuration but may be made and work effectively in a variety of different configurations. For example, the first material 18 may have a greater coefficient of friction, static or kinetic, in relation to a cornhole board 26 than the second material 20. As a result, there will be a greater frictional force acting on the first material 18 as the first material 18 sits or slides along a cornhole board 26, than the frictional force acting on the second material 20 as the second material 20 sits or slides along a cornhole board 26. In this configuration, the coefficients of static friction of the two materials in relation to the upper surface of a cornhole board may be identical but flipped to the ranges described above such that the first material 18 has the ranges of the second material 20 described above and the second material has the ranges of the first material 20 described above.

In yet another configuration, instead of the second surface 14 being comprised of two materials, the second surface 14 may be comprised of a single material and a texture. The single material may be identical to the material of the first surface 12. The texture may be rubber, silicone, or some other material known in the art and may be in the pattern of dots, squares, crosshatched, or some other pattern attached to the second surface 14. The texture may be attached locally around the center of the material of the second surface 14 such that a border of material without texture surrounds the textured material. Alternatively, the texture may be attached around the border of the second surface 14 such that the texture borders the central material that does not have texture.

Figure 4:
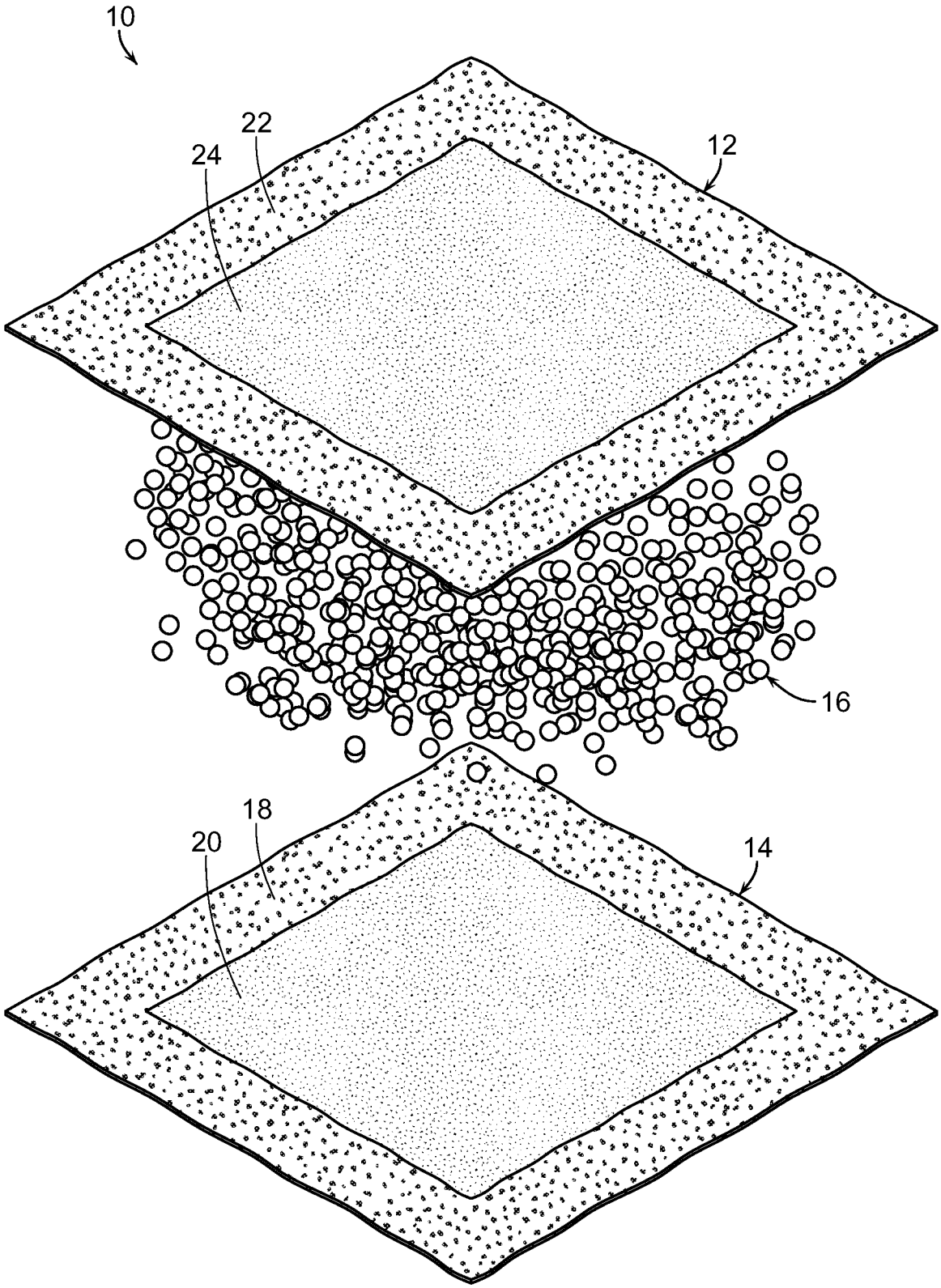
FIG. 4 illustrates an exploded perspective view of an alternative embodiment of the cornhole bag of FIGS. 1-3.

With reference now to FIG. 4, yet another configuration of the cornhole bag 10 is shown. FIG. 4 illustrates that the first surface 12, similar to the second surface 14, may be comprised of a third material 22 and a fourth material 24. Similar to the second surface 14 described above, the fourth material 24 of the first surface 12 may be in the shape of a quadrilateral. For example, the fourth material 24 may be in the shape of a square. In relation to the third material 22, the fourth material 24 may be adjacent to the third material 22. In addition, the fourth material 24 may be surrounded by the third material 22 such that the third material 22 forms a frame around the fourth material 24 so as to completely border the fourth material 24. The fourth material 24 may range in size from a square with about quarter-inch sides to a square with about five-and-three-quarters-inch sides. The thickness of the boarder formed by the third material 22 may correspondingly range from about five-and-three-quarters-inches to about a quarter-inch such that the first surface 12 is about a six-inch square. For example, in one embodiment, the fourth material 24 may be a five-inch square with the third material 22 being a border with a thickness of one-inch. However, the exact size of the third material 22 and the fourth material 24 may be adjusted to accommodate a larger cornhole bag 10 or a smaller cornhole bag 10 and are not limited to the size description above.

The third material 22 and fourth material 24 may have friction coefficients, static and kinetic, in similar fashion to the embodiments of the second surface 14 described above. For example, the third material 22 of the first surface 12 may be identical to the first material 18 of the second surface 14. Similarly, the fourth material 24 of the first surface 12 may be identical to the second material 20 of the second surface 14. Alternatively, the material of the first surface 12 may be opposite from the material of the second surface 14 such that the third material 22 of the first surface 12 is identical to the second material 20 of the second surface 14 and the fourth material 24 of the first surface 12 is identical to the first material 18 of the second surface 14. In the alternative, the material of the first surface 12 may be completely different from the material of the bottom surface 14 such that the third material 22 and the fourth material 24 of the first surface 12 have completely different coefficients of friction, static and kinetic, as compared to the first material 18 and the second material 20 of the second surface 14.

Alternatively, similar to the texturing of the second surface 14 as described above, the first surface 12 may be comprised of a single material and a texture. The texture may be rubber, silicone, or some other material known in the art and may be in the pattern of dots, squares, crosshatched, or some other pattern attached to the first surface 12. The texture may be attached locally around the center of the material of the first surface 12 such that a border of material without texture surrounds the textured material. Alternatively, the texture may be attached around the border of the first surface 12 such that the texture borders the central material that does not have texture.

Figure 5:
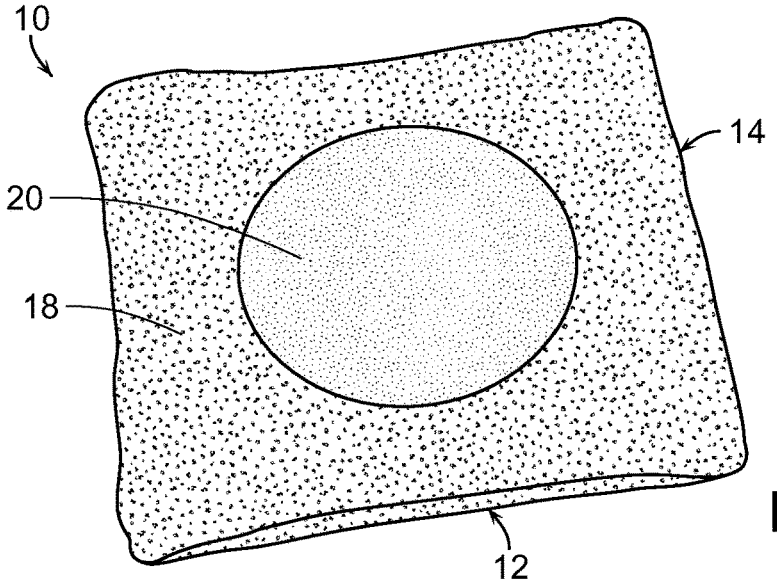
FIG. 5 illustrates a bottom perspective view of another alternative embodiment of the cornhole bag of FIGS. 1-3.

With reference now to FIG. 5, yet another cornhole 10 embodying the present invention is shown with a different configuration, wherein the second material 20 of the second surface 14 may be in the shape of an ellipse. For example, the second material 20 may be in the shape of a circle. This figure is intended to illustrate that the second material 20 need not be in the shape of a quadrilateral but may be in any other shape including but not limited to an ellipse, a star, a triangle, a hexagon, an octagon, some other polygon, or some other figure.

Alternatively, the first surface 12, as described above, may also be comprised of a third material 22 and a forth material 24. FIG. 5 again illustrates that the fourth material 24 need not be in the shape of a quadrilateral, but may be in any other shape, as described above.

Figure 6:
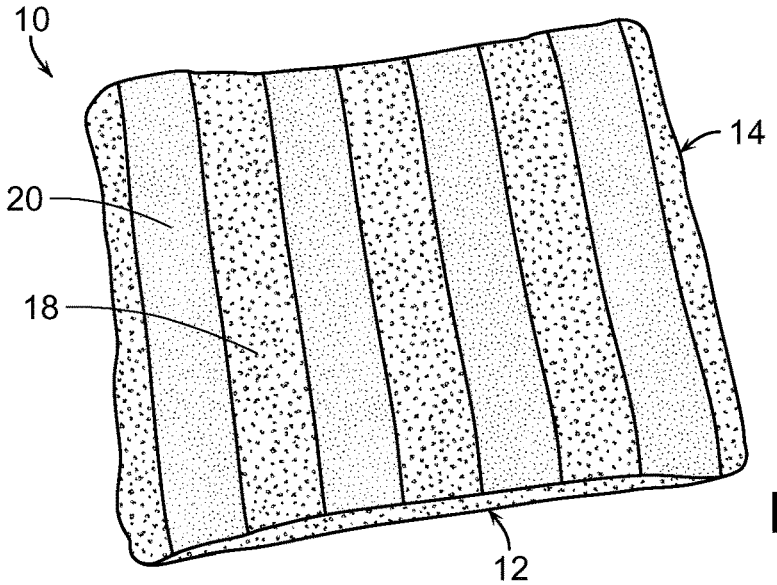
FIG. 6 illustrates a bottom perspective view of another alternative embodiment of the cornhole bag of FIGS. 1-3.

With reference now to FIG. 6, yet another cornhole bag 10 embodying the present invention is shown. In this case, the second surface 14 may be comprised of a first material 18 and a second material 20. FIG. 6 illustrates that instead of the second material 20 being completely bordered by the first material 18, the first material 18 and the second material 20 may alternate in stripes. In addition, second surface 14 may be comprised of a plurality of alternating stripes wherein both ends of the second surface 14 is comprised of identical material. For example, the second surface 14 may be comprised of a plurality of alternating stripes with both ends of the second surface 14 being comprised of the first material 18. Alternatively, both ends of the second surface may be comprised of the second material 20. This same configuration may be applied to the first surface 12 in relation to the third material 22 and the fourth material 24.

Figure 7:
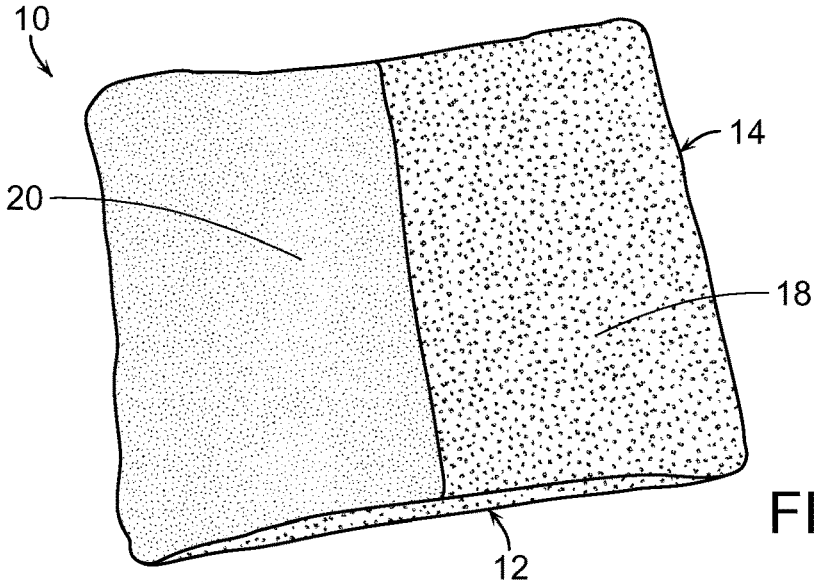
FIG. 7 illustrates a bottom perspective view of yet another alternative embodiment of the cornhole bag of FIGS. 1-3.

With reference now to FIG. 7, yet another cornhole bag 10 embodying the present invention is shown. In this case, the second surface 14 may be comprised of at least one section of first material 18 on one side of the second surface 14 and at least one section of second material 20 on the opposite side of the second surface 14. The first material 18 and the second material 20 may be adjacent to each other. This same configuration may be applied to the first surface 12 in relation to the third material 22 and the fourth material 24.

With reference now to FIG. 7, the game of cornhole will be described in more detail along with a process of using the cornhole bag 10. As shown in the figure, the game cornhole is comprised of two cornhole boards 26 and 27. The upper surfaces 28 of the cornhole boards 26 and 27 each contain an aperture 30 through which the cornhole bag 10 may fall. A player 32 stands at one cornhole board 27 and tosses the cornhole bag 10 toward the opposite cornhole board 26 and tries to either land the cornhole bag 10 on the upper surface 28 of the cornhole board 26 or through the aperture 30. A second player and opponent of the first player 32 may also stand at the same cornhole board 27 and toss the cornhole bag 10 toward the opposite cornhole board 26. Generally, the cornhole boards 26 and 27 are placed about twenty-four feet apart for casual games and about twenty-seven feet apart for official tournament games.

The cornhole bag 10 may be utilized in the sport of cornhole through the steps which will follow after the following references are established. The ground will be taken to be zero degrees. The angle of the cornhole bag 10 will be referenced from a line around the perimeter of the cornhole bag where the upper surface 12 and the lower surface 14 meet. Thus, a cornhole bag 10 thrown parallel to the ground will be angled at zero degrees. A cornhole bag 10 thrown at an angle of 30 degrees in relation to the ground will be angled at 30 degrees. The upper surface 28 of a cornhole board 26 has an angle of approximately 9.6 degrees with reference to the ground. Thus, a cornhole bag 10 thrown at an angle of 80.4 degrees, with reference to the ground, toward a cornhole board 10, will be angled orthogonally in relation to the upper surface 28 of the cornhole board 26.

With these references in mind, the cornhole bag 10 may be utilized in the sport of cornhole through the following steps. First, a cornhole bag 10 embodying the present invention described above should be provided to a player 32. Second, the player 32 should position himself/herself a distance of about twenty-four feet to about twenty-seven feet away from and facing a first cornhole board 26 while holding the cornhole bag 10, preferably holding the cornhole bag 10 in the player's32 dominant hand. In this position, the player 32 should be standing to the side of a second cornhole board 27. Next, the player 32 performs one of the following steps. First, the player 32 may toss the cornhole bag 10 in a parabolic path toward the cornhole board 26. The player 32 should position the cornhole bag 10 in his or her hand such that when it is tossed, the cornhole bag 10 spins about a central axis such that the second surface 14 points downward toward the ground and the cornhole bag has an angle in relation to the ground of about zero degrees to about 80.4 degrees. When the cornhole bag 10 is tossed in this manner, the cornhole bag 10 will make contact with the cornhole board such that the first material 18 of the second surface 14 will make contact with the cornhole board 26 before the second material 20 of the second surface 14 makes contact with the cornhole board 26. This will allow the first material 18 to have longer contact with the cornhole board 26 than the contact the second material 20 has with the cornhole board 26.

Second, the player 32 may toss the cornhole bag 10 in a parabolic path toward the cornhole board 26. The player 32 should position the cornhole bag 10 such that when it is tossed, the cornhole bag 10 spins about a central axis such that the second surface 14 points downward toward the ground and is substantially parallel to the upper surface 28 of the cornhole board 26. When the cornhole bag 10 is tossed in this manner, the cornhole bag 10 will make contact with the cornhole board 26 such that the second material 20 and the first material 18 make contact with the upper surface 28 of the cornhole board 26 at substantially the same time. This will allow the first material 18 and the second material 20 to have substantially equal timespans of contact with the cornhole board 26.

Third, the player 32 may toss the cornhole bag 10 in a parabolic path toward the cornhole board 26. The player 32 should position the cornhole bag 10 such that when it is tossed, the cornhole bag 10 spins about a central axis such that the first surface 12 of the cornhole bag 10 points downward toward the ground. When the cornhole bag 10 is tossed in this manner, the first surface 12 will make contact with the upper surface 28 of the cornhole board.

Finally, the player 32 may toss the cornhole bag 10 with the first surface 12 of the cornhole bag in the same positions as the second surface 14 described in steps one and two above.

Although several embodiments and a related process have been described in detail for purposes of illustration, various modifications may be made without departing from the scope and spirit of the invention.

What is claimed is:

1. A cornhole bag, comprising:

a first surface;

a second surface; and a filling;

wherein the filling is enclosed between the first surface and the second surface;

wherein the second surface is comprised of a high friction surface area and a low friction surface area;

wherein the high friction surface area has a greater coefficient of friction in relation to a playing surface of a cornhole board and the low friction surface area has a lesser coefficient of friction in relation to the playing surface; and wherein the low friction surface area forms a frame completely around peripheral edges of the second surface and wherein the high friction surface area is approximately centered on the second surface and completely bordered by the low friction surface area.

2. The cornhole bag of claim 1, wherein the high friction surface area is directly adjacent to the low friction surface area.

3. The cornhole bag of claim 1, wherein the high friction surface area is in the shape of a polygon.

4. The cornhole bag of claim 1, wherein the high friction surface area is in the shape of an ellipse.

5. The cornhole bag of claim 1, wherein the difference between the coefficient of friction of the high friction surface area and the coefficient of friction of the low friction surface area is within a range of about 0.05 to about 0.42.

6. The cornhole bag of claim 1, wherein the first surface is comprised of a single low friction surface area.

7. The cornhole bag of claim 6, wherein the single low friction surface area of the first surface and the low friction surface area of the second surface are identical in composition.

8. The cornhole bag of claim 1, wherein the low friction surface area has a surface area of at least eleven square inches.

9. A cornhole bag, comprising:

a first surface;

a second surface, the second surface comprising a high friction surface area and a low friction surface area; and a filling enclosed between the first surface and the second surface;

wherein the high friction surface area is approximately centered on the second surface and shares a common border with the low friction surface area;

wherein the high friction surface area has a greater coefficient of friction in relation to a playing surface of a cornhole board and the low friction surface area has a lesser coefficient of friction in relation to the playing surface; and wherein the high friction surface area has a surface area of at least four square inches.

10. The cornhole bag of claim 9, wherein the difference between the coefficient of friction of the high friction surface area and the coefficient of friction of the low friction surface area is at least 0.05.

11. The cornhole bag of claim 9, wherein the high friction surface area is in the shape of a polygon.

12. The cornhole bag of claim 9, wherein the high friction surface area is in the shape of an ellipse.

13. The cornhole bag of claim 9, wherein the low friction surface area forms a frame around peripheral edges of the second surface.

14. The cornhole bag of claim 9, wherein the first surface is comprised of a single low friction surface area identical in composition to the low friction surface area of the second surface.

15. A cornhole bag, comprising:

a first surface;

a second surface, the second surface comprising a high friction surface area and low friction surface area; and a filling enclosed between the first surface and the second surface;

wherein the high friction surface area is comprised of a pattern of high friction polymer;

wherein the high friction surface area has a greater coefficient of friction in relation to a playing surface of a cornhole board and the low friction surface area has a lesser coefficient of friction in relation to the playing surface; and wherein the low friction surface area forms a frame completely around peripheral edges of the second surface and wherein the pattern of high friction polymer of the high friction surface area is approximately centered on the second surface and completely bordered by the low friction surface area.

16. The cornhole bag of claim 15, wherein the difference between the coefficient of friction of the pattern of high friction polymer of the high friction surface area and the coefficient of friction of the low friction surface area is at least 0.05.

17. The cornhole bag of claim 15, wherein the pattern of high friction polymer of the high friction surface area spans an area of at least four square inches.

18. The cornhole bag of claim 15, wherein the pattern of high friction polymer of the high friction surface area is an array of dots.

19. The cornhole bag of claim 15, wherein the pattern of high friction polymer of the high friction surface area is crosshatched.

20. The cornhole bag of claim 15, wherein the first surface is comprised of a single low friction surface area identical in composition to the low friction surface area of the second surface.

* * * * *